United States Patent [19]

Intini

[11] Patent Number: 4,988,004

[45] Date of Patent: Jan. 29, 1991

[54] BEND 'N PEEL CHILD RESISTANT/TAMPER EVIDENT BLISTER PACKAGE

[76] Inventor: Thomas D. Intini, 9720 Recollet Street, Brossard, Quebec J4X 1B9, Canada

[21] Appl. No.: 492,344

[22] Filed: Mar. 12, 1990

Related U.S. Application Data

[63] Continuation of Ser. No. 327,427, Mar. 24, 1989, abandoned, which is a continuation of Ser. No. 87,761, Aug. 21, 1987, abandoned.

[51] Int. Cl.[5] ..... B65D 27/08

[52] U.S. Cl. ..... 206/532; 206/538; 206/469

[58] Field of Search ..... 206/484, 532, 538, 807

[56] References Cited

U.S. PATENT DOCUMENTS

| | | | |
|---|---|---|---|
| 3,255,880 | 6/1966 | Grossman | 206/469 |
| 3,921,805 | 11/1975 | Compere | 206/469 |
| 4,311,234 | 1/1982 | Wildgoose | 206/469 |
| 4,371,080 | 2/1983 | Haings | 206/431 |
| 4,506,789 | 3/1985 | Dlugosz | 206/532 |
| 4,666,040 | 5/1987 | Murata | 206/469 |

FOREIGN PATENT DOCUMENTS

| | | | |
|---|---|---|---|
| 2003819 | 3/1979 | United Kingdom | 206/469 |

*Primary Examiner*—Joseph Man-Fu Moy

*Attorney, Agent, or Firm*—Watson, Cole, Grindle & Watson

[57] ABSTRACT

A blister package has some provision for showing evidence of tampering and is child resistant. It is reinforced by a backing sheet made of a material which separates into strata on tearing and adhered to a rupturable film closing article containing pockets. The backing sheet is provided with tabbed tear strips overlying the pockets. On tearing the tear strips separate into strata indicating that opening has been started.

3 Claims, 3 Drawing Sheets

FIG. 7
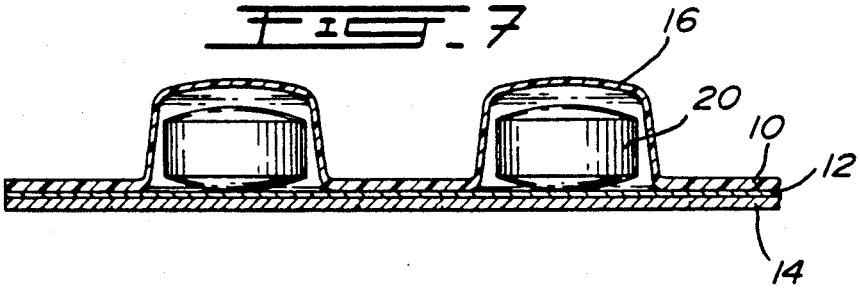
FIG. 8
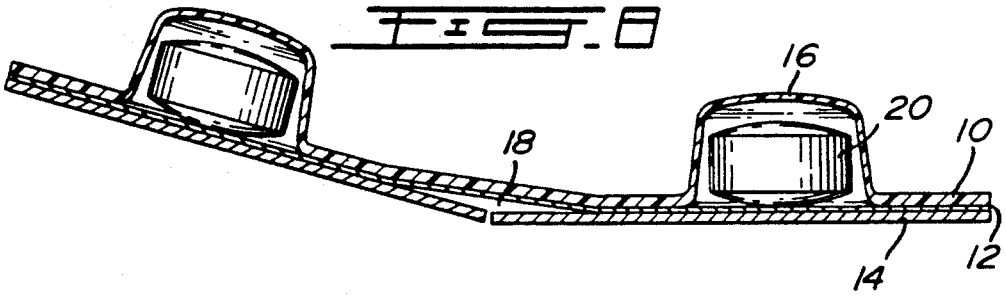
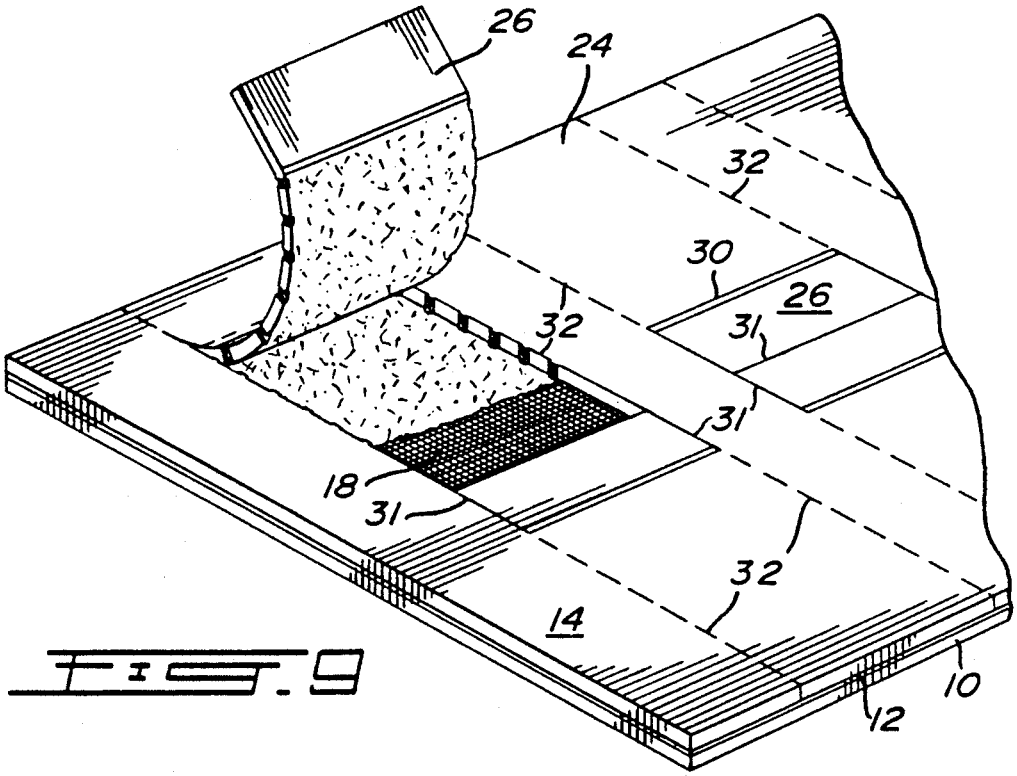
FIG. 9

BEND 'N PEEL CHILD RESISTANT/TAMPER EVIDENT BLISTER PACKAGE

This application is a continuation of application Ser. No. 327,427, filed 3/24/89, which is a continuation of application Ser. No. 087,761, filed 8/21/87.

The present invention relates to a tamper-evident, child resistant package of the type openable by means of a tear strip. The invention especially relates to blister packs provided with tear strips to access the blisters. More especially the invention relates to blister packs adapted to contain unit dose capsules, tablets or like products.

It is desirable to provide for tamper evident packaging which will give a clear indication when the package has been subject to tampering. However, at the same time the package must be sufficiently easy for the average consumer to open while, preferably, being child-resistant.

A conventional package often comprises a laminate of a blister layer having article receiving pockets with a foil backing layer. The foil material is rupturable to release the article. While such a package is tamper-evident unless the whole foil layer is replaced, it is not very child resistant. U.S. Pat. No. 4,537,312 to Intini shows one improvement over the conventional blister packages described. That patent describes and claims a package in which such a conventional package is enclosed between an outer front layer and an outer back layer sized larger than the conventional package and sealed to one another around their periphery and through apertures in the laminate. Tabs are provided at the edges of the sealed front and back layers connected to tear strips in the back layer each of which overlies foil covering a blister pocket. At least the tear strips of the back layer are made of a material which, on tearing, will leave a stratum still overlying the foil to thereby reinforce it.

Such a package is, due to the provision of both front and back layers, considerably more expensive in materials and manufacturing steps than the simple blister pockets with unprotected foil backing. Moreover, in some cases where the contents of the pockets are very light, increase the weight and thus shipping costs by a very substantial amount. Moreover, the manufacturing steps involved are dependent on the number of layers in the package.

It is an object of the present invention to provide an improved tamper-evident, child resistant, blister package.

It is a further object of the invention to provide a tamper-evident, child resistant, blister package having a reinforcement against tampering in which the weight and hence material, manufacturing and shipping costs are reduced.

Another object of the invention is to provide a simple method of making a tamper-evident, child resistant, blister package.

According to the invention is provided a blister package to contain a number of articles, such as medicaments in the form of capsules, tablets or the like or nonmedicaments such as batteries, nuts, bolts, hooks or other small hardware, comprising an outer front blister layer including a number of article receiving pockets, a rupturable film sealed to the blister layer and overlying the pockets, and a reinforcing back layer formed of material which, on tearing, separates into strata, the back layer comprising a matrix adhered to the rupturable film sealed to the blister layer, a number of tear strips adhered to the rupturable film overlying the pockets and a manually grippable tab for each tear strip, the tabs being free of the rupturable film.

Preferably the blister layer is provided with a number of indentations, each indentation being in the vicinity of at least one of the pockets, and at least one tab overlying an indentation whereby finger access to the tab is aided.

More preferably, when indentations are provided, the rupturable film extends into the indentations and is sealed onto a surface of the indentation.

According to another aspect of the invention is provided a method of forming a blister package comprising forming a blister sheet with a front surface and a rear surface and having a number of pockets open at the rear surface, delivering an article such as a capsule, tablet or the like into each pocket, sealing a rupturable film to the blister sheet rear surface to close the pockets, selectively adhering the rupturable film to a reinforcing layer whereby portions of film and layer in the vicinity of each pocket are free from each other, the reinforcing layer being formed of material which, on tearing, separates into strata and comprising a matrix having a number of tear strips located to overlie the pockets and a manually grippable tab for each tear strip, each tab comprising a free portion of the rupturable film.

Preferably the rupturable film may be selectively adhered to the reinforcing layer by applying a heat sealable coating to the bottom of the rupturable film and/or a compatible heat sealable coating to the top surface of the reinforcing layer and applying heat and pressure to seal the film to the layer except to said portions whereby said portions of layer and film are unsealed.

Preferably the blister layer is provided with a number of indentations, each indentation being in the vicinity of at least one of the pockets, and the portions of the rupturable film and reinforcing layer overlie the indentations.

More preferably, when indentations are provided, the rupturable film extends into the indentations and is sealed onto a surface of the indentation by means of a heat sealable coating compatible with the blister layer. Conveniently the indentations are formed after sealing of the rupturable film to the blister sheet, for example by pressing. As is known in the art the blister sheet may include plurality of article receiving pockets for unit doses of pharmaceutical products. The sheet may comprise a normally rectangular continuous blister sheet of a flexible clear film which cannot be easily ruptured. Such a film may be, for example, a vinyl thermoplastic film about 12 mls thick. Examples of rupturable film are also well known in the art. It may be co-extensive with the blister sheet and may be formed of aluminum foil approximately 1 ml thick and may be joined to the blister sheet by conventional heat sealable coatings under heat and pressure.

The reinforcing layer is suitably a paper product, for example card. The tear strip may be defined by parallel lines of perforations or slots in the reinforcing layer forming longitudinal tear lines of the strip. One end of the strip may end at the edge of the reinforcing layer and at the other end it may be provided with its tab. The tab may be rectangular and integral with the strip at one tab edge while the other three edges may be defined by cuts through the reinforcing layer. To facilitate bending the tab outwardly from the tear strip and matrix without disturbing the tear strip, a score line may be provided between tab and tear strip.

An embodiment of the invention will now be described by way of example with reference to the drawings, in which.

Figure 1:
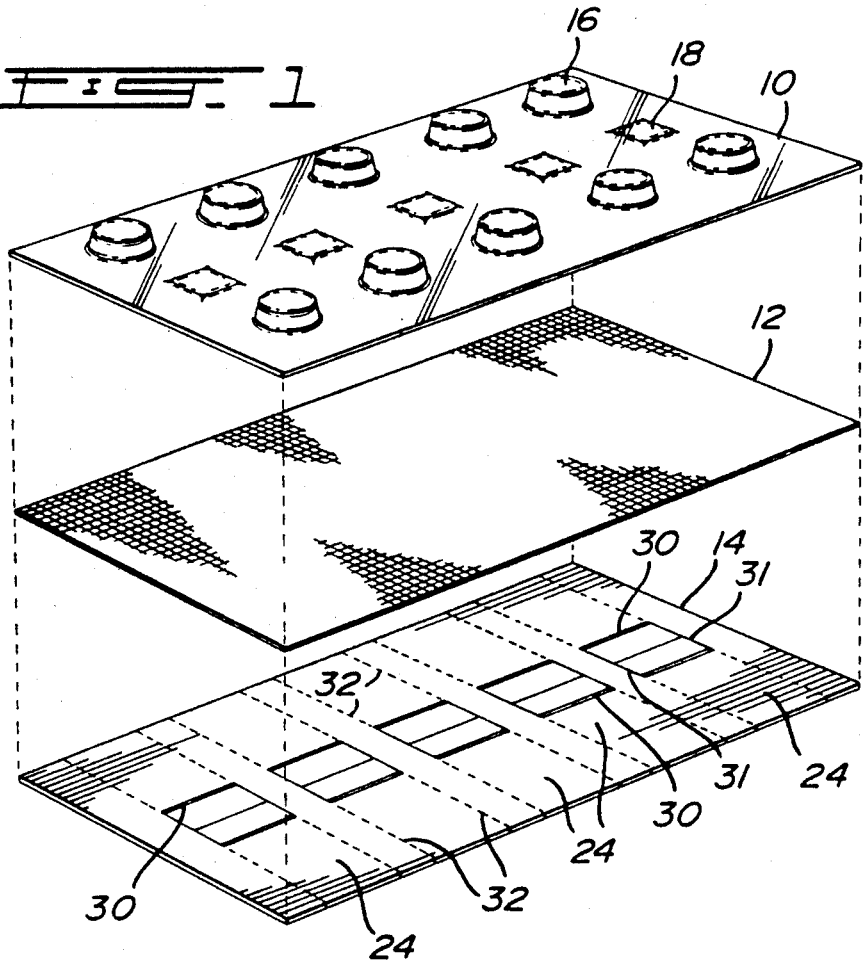
FIG. 1 is an isometric exploded view of a package embodying the invention.
Figure 2:
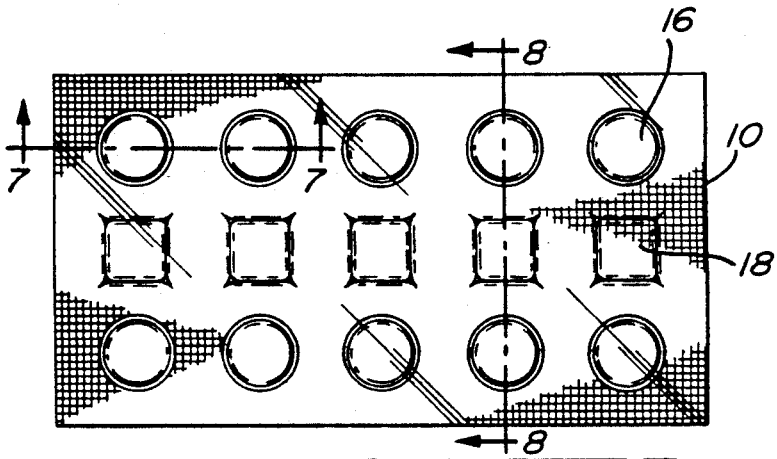
FIG. 2 is a top elevational of the package of FIG. 1.
Figure 3:
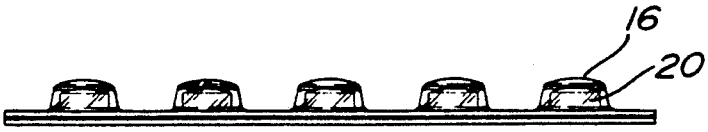
FIG. 3 is a side elevation of the package of FIGS. 1 and 2.
Figure 4:
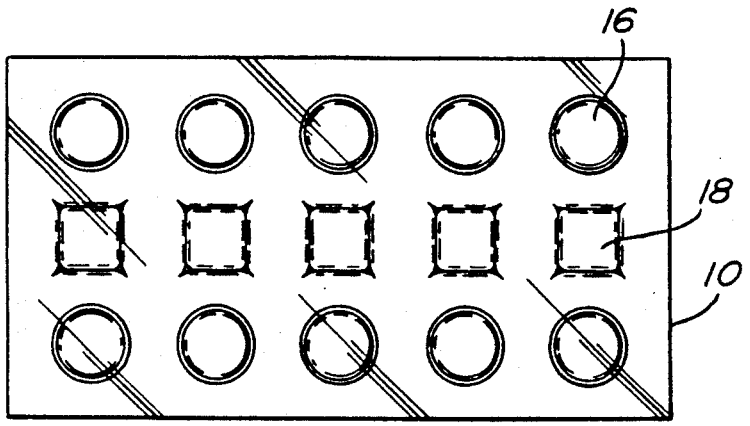
FIG. 4 is a bottom plan view of the blister sheet of the illustrated package.
Figure 5:
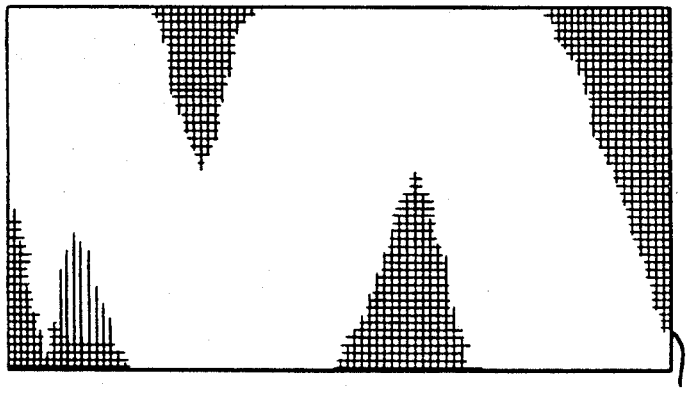
Figure 6:
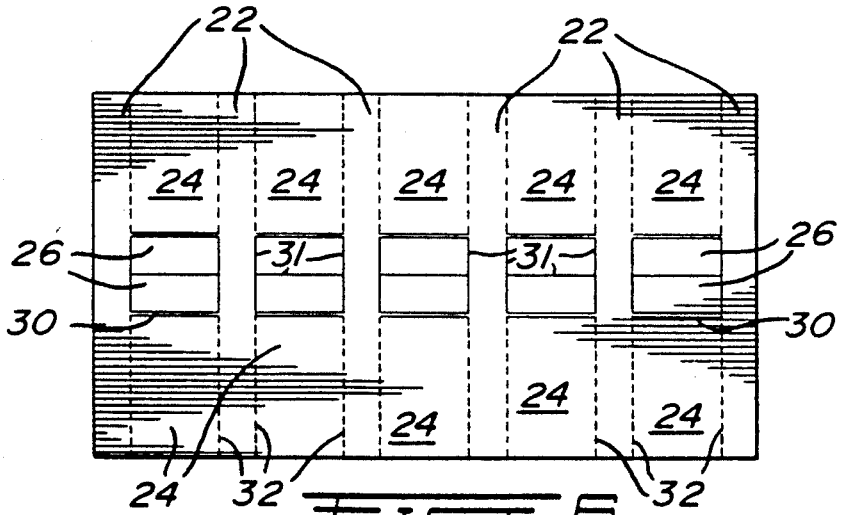

FIG. 5 is a bottom plan view of the blister sheet with rupturable film in place, FIG. 6 is a bottom plan view of the complete package, FIG. 7 is a section along the line 7—7 of FIG. 2, FIG. 8 is a section along line 8—8 of FIG. 2 showing the package bent to expose the leading edge of a tab to facilitate opening, FIG. 9 is a partial isometric view of a tablet containing package illustrating removal of the tab and tear strip.

Referring to the drawings, a package for unit doses of pharmaceutical tablets comprises a front blister sheet 10, rupturable film 12 and a reinforcing layer 14. The blister sheet 10 may be clear, vinyl plastic about 12 ml thick, the rupturable film is usually foil about 1 ml thick and will, hereinafter be referred to as foil, and the reinforcing layer may be card and may be of any convenient thickness as will separate into strata on tearing.

The blister sheet 10 comprises a number of bubbles or pockets 16 projecting from its front surface to contain tablets 28 and also is provided with indentations 18 each of which is located between two pockets 16. Foil 12 is sealed onto the rear surface of blister sheet 10 in any convenient manner for example, by the use of a conventional sealant to close the pockets 16.

In manufacture, the indentations 18 may be formed in the blister sheet before or after the foil is applied. It is however, convenient to apply the foil to the flat surface and thereafter form the indentations, stretching the foil slightly in the process.

The reinforcing layer 14 may be adhered to the foil 12 using a suitable heat sealable coating which is applied all over the surface of the foil, for example by means of a flexographic printing press. Alternatively, the coating may be applied to the reinforcing layer.

The reinforcing layer comprises a matrix 22 and tear strips 24 having tabs 26, the layer being proportioned and located so that the tear strips 24 lie over the closed pockets 16 and the tabs lie over the indentations 18. The matrix 22 and the tear strips are firmly attached to the foil 12 by the adhesive such that any attempt to pull the matrix and/or the tear strips 24 away will result in the reinforcing layer 14 separating into strata 28 (see FIG. 9) rather than total removal from the foil 12.

The tear strips 24 are formed by parallel cuts from edge to edge of the reinforcing layer. The cuts are located so that the strip between each pair of cuts covers two pockets 16 and an indentation 18 thus forming two tear strips 24 and their tabs 26 so that the reinforcing layer will remain of unitary structure before it is applied to the foil 14, it is convenient that at least over part of the length of each cut there are interruptions of the cut. Thus suitably, the cuts have slotted or perforated portions 32 over the length of the tear strip 24. That portion 31 of the cuts defining the tabs 26 should be made as clean cuts so that the tab is more easily grasped in the fingers. The tabs 26 are delineated from their respective tear strips by a score line 30 whereby the tabs 26 are more easily bent away from the package to be grasped in the fingers.

While a package of particular configuration of reinforcing layer has been described, it is to be appreciated that the configuration of the reinforcing layer is only of importance in that the tear strips 24 should overlay the pockets and that the grippable tabs 26 should not adhere to the foil. In particular, an embodiment is described in which two tabs from different tear strips are located to share the unsealed area of single indentation. Clearly, an indentation may be provided for each tab if desired.

In operation, the user wishing to obtain a tablet from a pocket bends the package thereby exposing the leading edge of one of the tabs 26. He can then grip the tab 26 in his fingers. Alternatively, as the finger approaches the tab, it will automatically push the adjacent tab 26 into the underlying indentation 18 facilitating access to the desired tab 26. Having taken hold of the tab, the user pulls it outwardly and toward the edge of the package generally parallel to the cuts 32 defining the long edges of the tear strip 24. The tear strip 24 will separate into strata 28 and the top stratum attached to the tab 26 will pull back revealing the bottom stratum and indicating that the package is partially open or that an attempt has been made to open it. The tablet may thereafter be accessed through the bottom strata and the foil by conventional means such as by pushing the tablet and pocket towards it while at the same time deforming the pocket to stretch the foil and reinforcing layer to a point which facilitates breaking them with the aid of the product to be dispensed.

I claim:

1. A child-resistant tamper evident package such as medicaments in the form of capsules, tablets or the like, the package comprising an outer front blister layer having a plurality of article receiving pockets formed therein, a rupturable foil being sealed to planar portions of the back of the blister layer to thereby form a continuous uninterrupted cover over said pockets, said foil being of a thickness and material which can be ruptured to provide access to the pockets, and a reinforcing back layer formed of a paper board material, a major portion of said back layer being adhered to said foil layer and a minor portion being non-adhered thereto, said paperboard back layer being adapted to separate into strata, a plurality of tear strips formed in said reinforcing back layer, each tear strip being associated with one of said article receiving pockets, a tab member formed at one end of each of said tear strips, said tear strips being defined by a plurality of spaced apart cuts formed in said reinforcing back layer, said tab members forming said minor portion of said reinforcing back layer which is not adhered to said foil layer.

2. The package according to claim 1 wherein said blister layer has a plurality of indentations formed therein, each one of said indentations being associated with one of said tab members.

3. The package according to claim 2 wherein the rupturable film extends into the indentations and is sealed onto a surface of the indentation.

* * * * *